US007360488B2

(12) United States Patent
Stawovy

(10) Patent No.: US 7,360,488 B2
(45) Date of Patent: Apr. 22, 2008

(54) SINGLE PHASE TUNGSTEN ALLOY

(75) Inventor: Michael T. Stawovy, Limestone, TN (US)

(73) Assignee: Aerojet - General Corporation, Jonesborough, TN (US)

( * ) Notice: Subject to any disclaimer, the term of this patent is extended or adjusted under 35 U.S.C. 154(b) by 301 days.

(21) Appl. No.: 10/837,516

(22) Filed: Apr. 30, 2004

(65) Prior Publication Data

US 2005/0241522 A1 Nov. 3, 2005

(51) Int. Cl.
*F42B 1/032* (2006.01)
*C22C 19/03* (2006.01)

(52) U.S. Cl. ..... 102/306; 102/476; 420/441; 75/246

(58) Field of Classification Search ..... 102/476, 102/306, 307, 308, 309, 310; 420/441; 75/246

See application file for complete search history.

(56) References Cited

U.S. PATENT DOCUMENTS

| | | | | | |
|---|---|---|---|---|---|
| 3,355,286 | A | | 11/1967 | Williams et al. | 420/580 |
| 3,490,372 | A | | 1/1970 | Lavane | 102/24 |
| 3,988,118 | A | * | 10/1976 | Grierson et al. | 75/248 |
| 4,623,402 | A | * | 11/1986 | Maximov et al. | 419/13 |
| 4,762,559 | A | * | 8/1988 | Penrice et al. | 75/248 |
| 4,766,813 | A | | 8/1988 | Winter et al. | 102/307 |
| 4,784,690 | A | * | 11/1988 | Mullendore | 75/248 |
| 4,851,042 | A | * | 7/1989 | Bose et al. | 75/248 |
| 4,958,569 | A | | 9/1990 | Mandigo | 102/476 |
| 5,064,462 | A | * | 11/1991 | Mullendore et al. | 75/248 |
| 5,098,487 | A | | 3/1992 | Brauer et al. | 148/432 |
| 5,331,895 | A | * | 7/1994 | Bourne et al. | 102/307 |
| 5,462,576 | A | | 10/1995 | Stuitje et al. | 75/248 |
| 5,760,317 | A | | 6/1998 | Kapoor | 75/248 |
| 6,270,549 | B1 | | 8/2001 | Amick | 75/255 |
| 6,393,991 | B1 | | 5/2002 | Funston et al. | 102/476 |
| 6,447,715 | B1 | | 9/2002 | Amick | 420/430 |
| 6,527,880 | B2 | | 3/2003 | Amick | 148/423 |
| 6,530,326 | B1 | | 3/2003 | Wendt, Jr. et al. | 102/306 |

(Continued)

FOREIGN PATENT DOCUMENTS

EP 962542 A1 * 12/1999

(Continued)

OTHER PUBLICATIONS

Caldwell, "Tungsten Heavy Alloys," *ASM Handbook*, vol. 7, Powder Metal Technologies and Applications, 1998, pp. 914-921.

(Continued)

*Primary Examiner*—James S Bergin
(74) *Attorney, Agent, or Firm*—Wiggin and Dana LLP; Gregory S. Rosenblatt

(57) ABSTRACT

A single phase metal alloy usually for forming a shaped charge liner for a penetrating jet or explosively formed penetrator forming warhead consists essentially of from a trace to 90%, by weight, of cobalt, from 10% to 50% by weight, of tungsten, and the balance nickel and inevitable impurities. One preferred composition is, by weight, from 16% to 22%, cobalt, from 35% to 40% tungsten and the balance is nickel and inevitable impurities. The alloy is worked and recrystallized and then formed into a desired product. In addition to a shaped charge liner, other useful products include a fragmentation warhead, a warhead casing, ammunition, radiation shielding and weighting.

5 Claims, 3 Drawing Sheets

U.S. PATENT DOCUMENTS

| | | | | |
|---|---|---|---|---|
| 6,564,718 | B2 | 5/2003 | Reese et al. | 102/307 |
| 6,576,037 | B1 * | 6/2003 | Bonneau et al. | 75/246 |
| 6,634,300 | B2 | 10/2003 | Reese et al. | 102/307 |
| 6,740,176 | B2 * | 5/2004 | Ford et al. | 148/426 |
| 6,823,798 | B2 | 11/2004 | Amick | 102/517 |
| 2004/0033155 | A1 | 2/2004 | Park et al. | 420/430 |
| 2004/0255812 | A1 * | 12/2004 | Bourne et al. | 102/476 |
| 2005/0241522 | A1 * | 11/2005 | Stawovy | 102/476 |

FOREIGN PATENT DOCUMENTS

| | | | |
|---|---|---|---|
| WO | WO 92/20481 | * 11/1992 | |
| WO | 2001/04370 | 1/2001 | 420/430 |

OTHER PUBLICATIONS

Zhou et al., "Shear Band Formation in W-Ni-Fe Alloy Under Plate Impact," *Tungsten & Tungsten Alloys—1992*, 1993, pp. 343-356.

Brown et al., "Prospects for the Application of Tungsten as a Shaped Charge Liner Material," *Tungsten & Tungsten Alloys—1992*, 1993, pp. 343-356.

*ASM Handbook*, vol. 3, Alloy Phase Diagrams, edited by H. Baker, 1992 at pp. 2•320 and 3•55.

*Tungsten and Refractory Metals*, Metal Powder Industries Federation, edited by A. Bose et al., 1994, at pp. 93-100.

* cited by examiner

100 X

SINGLE PHASE TUNGSTEN ALLOY

CROSS REFERENCE TO RELATED APPLICATION(S)

Not Applicable.

U.S. GOVERNMENT RIGHTS

Not Applicable.

BACKGROUND OF THE INVENTION

1. Field of the Invention

This invention relates to materials for forming a shaped charge liner. More particularly, a single phase alloy of nickel, tungsten and cobalt provides a liner having improved penetration performance and/or lower cost when compared to conventional materials.

2. Description of the Related Art

Shaped charge warheads are useful against targets having reinforced surfaces, such as rolled homogeneous steel armor and reinforced concrete. These targets include tanks and bunkers. Detonation of the shaped charge warhead forms a small diameter molten metal elongated cylinder referred to as a penetrating jet. This jet travels at a very high speed, typically in excess of 10 kilometers per second. The high velocity of the penetrating jet in combination with the high density of the material forming the jet generates a very high amount of kinetic energy enabling the penetrating jet to pierce the reinforced surface.

Similar to the penetrating jet is an explosively formed penetrator (EFP). An EFP is formed from a shaped charge warhead having a different liner configuration than that used to form a penetrating jet. The EFP has a larger diameter, shorter length and a slower speed than a high velocity penetrating jet.

Suitable materials for shaped charge liners to form EFPs and penetrating jets have low strength, low hardness and high elongation to failure. Wrought liners, formed by casting an ingot which is then reduced to a sheet of a desired thickness by a combination of rolling or swaging and annealing, utilize either expensive starting materials such as tantalum and silver or ductile materials having relatively low densities such iron (density=7.8 g/cm$^3$ and copper (density=8.9 g/cm$^3$). Molybdenum (density=10.2 g/cm$^3$) is typically formed using powder metallurgy and hot forged to near-net shape.

As disclosed in U.S. Pat. No. 6,530,326 to Wendt, Jr. et al., liners are also formed from a mixture of a tungsten powder and a powder with a lower density such as lead, bismuth, zinc, tin, uranium, silver, gold, antimony, cobalt, zinc alloys, tin alloys, nickel, palladium and copper. A polymer is added to the mixture to form a paste that is then injected into a mold of a desired liner shape. The liner is then chemically treated to remove most of the polymer and then heated to remove the remaining polymer and to sinter. U.S. Pat. No. 6,530,326 is incorporated by reference in its entirety herein.

An article entitled "Prospects for the Application of Tungsten as a Shaped Charge Liner Material" by Brown et al. discloses shaped charge liners formed from a mixture of tungsten, nickel and iron powders in the nominal weight amounts of 93% W-7% Ni-3% Fe. The powders are mixed, compacted and liquid phase sintered. It is disclosed that liners jets formed from this material broke up rapidly.

Tungsten base alloys having in excess of 90 weight percent of tungsten are conventionally referred to as tungsten heavy alloys (WHA) and have a density in the range of between 17 g/cm$^3$ and 18.5 g/cm$^3$. A WHA that has been used to produce kinetic energy penetrators, fragmentation warheads, radiation shielding, weighting and numerous other products is a mixture of tungsten, nickel, iron and cobalt. The products are formed by using a process of powder compaction followed by high-temperature liquid-phase sintering. During liquid phase sintering, nickel, cobalt and iron constituents of the compact melt and dissolve a portion of the tungsten. The result is a two-phase composite alloy having pure tungsten regions surrounded by a nickel-iron-cobalt-tungsten matrix alloy. It has been observed that the percentage of dissolved tungsten can be high.

There remains a need for a liner material effective to form shaped charge liners and explosively formed penetrator liners that does not have the disadvantage of poor jet performance of the two phase liners described above and also does not suffer from the high cost or low density problems of the wrought liners described above.

BRIEF SUMMARY OF THE INVENTION

In accordance with the invention, there is provided a single phase metal alloy consisting essentially of from a trace to 90%, by weight, of cobalt, from 10% to 50% by weight, of tungsten, and the balance nickel and inevitable impurities. One preferred composition is, by weight, from 16% to 22%, cobalt, from 35% to 40% tungsten and the balance is nickel and inevitable impurities. This alloy may be worked and recrystallized and then formed into a desired product such as a shaped charge liner, an explosively formed penetrator, a fragmentation warhead, a warhead casing, ammunition, radiation shielding and weighting.

The metal alloy may be formed by the process of casting a billet of an alloy of the desired composition, mechanically working the billet to form the alloy to a desired shape and recrystallizing the alloy.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

Like reference numbers and designations in the various drawings indicated like elements.

DETAILED DESCRIPTION

The alloys of the invention are single phase and lie within the gamma phase region of the tungsten-nickel-cobalt ternary phase diagram. Very broadly, the alloys contain from 0-100%, by weight, nickel, 0-100%, by weight, cobalt and 0-45% by weight, tungsten. For effective use as a material for a shaped charge liner for either a penetrating jet or an explosively formed penetrator, there must be sufficient tungsten to achieve an effective density. As such, the broad compositional ranges of the alloy of the invention is from 10%-50% by weight, tungsten, from 0-90% by weight, nickel and from 0-90% be weight, cobalt. More preferably, the alloy contains from 30-50% by weight tungsten, 10-30% by weight cobalt, and the balance is nickel and inevitable impurities. A most preferred composition, by weight, is 16-22% cobalt, 35-40% tungsten and the balance is nickel and inevitable impurities. An exemplary alloy is 44 weight percent nickel, 37 weight percent tungsten and 19 weight percent cobalt which has a density of 11.1 g/cm$^3$. While this density is lower than that of a WHA, the density is still higher than that of commonly used shaped charge liner materials. A higher density generally translates to better armor penetrating performance in shape charge and explosively formed penetrator liner applications. This alloy would outperform common liner materials such as iron, copper, silver and molybdenum because of the density advantage.

Other elements may be present as a partial substitute for either a portion or all of one or more of the constituent elements of the alloy provided that the alloy remains in a single phase region. Up to 50%, by weight, of molybdenum, iron and/or copper may be added as substitutes in whole or part for nickel and cobalt. Preferably, such substitutes account for no more than 25% of the alloy of the invention and most preferably no more than 5% of the alloy.

While expensive and less preferred, other high density metals such as platinum, gold, rhenium, tantalum, hafnium, mercury, iridium, osmium and/or uranium may substitute for a portion or all of the tungsten. Preferably, the alloy contains no more than 10%, by weight, of one or more of these high density substitutes for tungsten and more preferably no more than 5%, by weight, of one or more of these high density substitutes.

Figure 1:
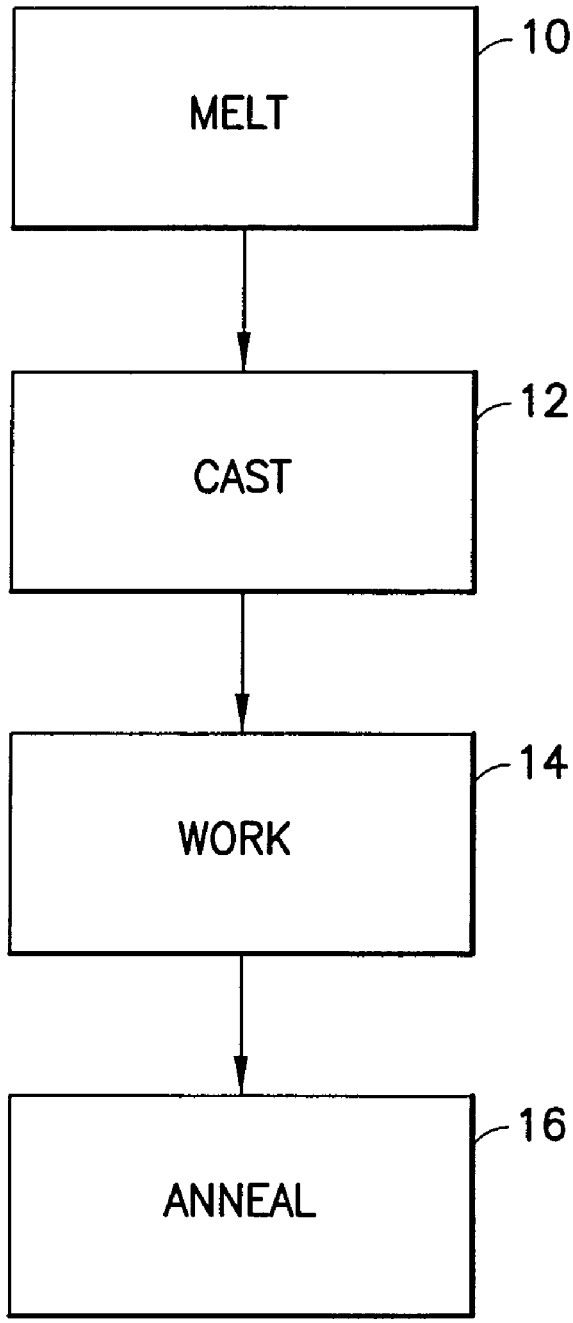
FIG. 1 shows in flow chart representation a process for the manufacture of shaped charge liners in accordance with the invention.

Referring now to FIG. 1, the constituent elements of the alloy are weighed to a desired chemistry and melted 10 in a vacuum. When the high density component is tungsten, an effective melting temperature is 1,600° C. and the melt is held above its solidification temperature for a time effective to dissolve the tungsten, such as one hour, prior to cooling. The molten alloy is poured into a mold while under the vacuum and vacuum cast 12 to form a billet. The resultant alloy remains as a single phase after solidification. Therefore, standard industrial processes may be used for production. Vacuum casting, similar to that used for nickel based super alloys, may be employed. Vacuum casting is widely applied in industry and is a much lower cost operation than the casting or powder metallurgy processes presently used to produce tantalum and molybdenum based liners. The starting constituents, nickel powder, tungsten powder and cobalt power, are substantially less expensive than tantalum. As a result, a low cost liner blank is produced by using the process of the invention.

The as-cast microstructure is very coarse and has limited mechanical properties. The billet is then mechanically worked such as by cold rolling or by swaging. The cold work preferably includes a reduction in cross-sectional area by swaging or reduction in thickness by rolling of from 10%-40% and preferably from about 20% to about 25%. The mechanical working can include a cupping or shaping operation to produce a near net shaped blank that is ready for final machining.

The shaped alloy is then annealed 16 at a temperature effective to recrystallize the alloy. For the tungsten-nickel-cobalt preferred embodiments of the invention, the anneal 16 may be performed in an inert atmosphere at a temperature of between 800° C. and 1,200° C. for one hour.

Figure 2:
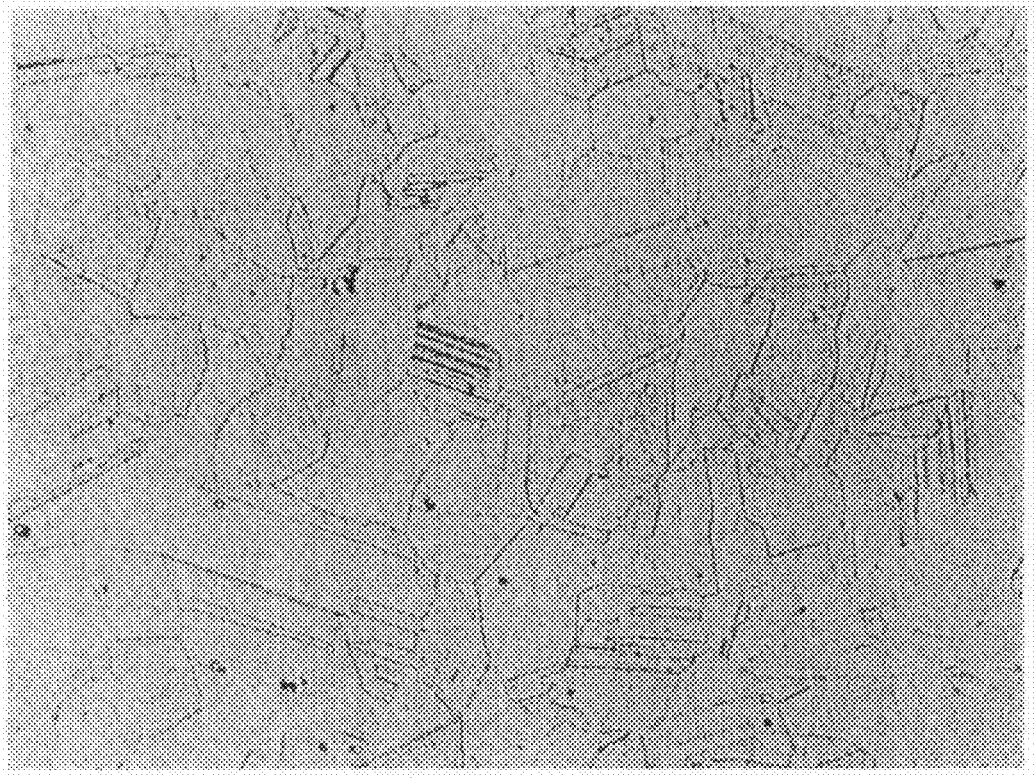
FIG. 2 is an optical photomicrograph of the alloy of the invention following forging and anneal.

FIG. 2 is an optical photomicrograph at a magnification of 100× of the tungsten-cobalt-nickel alloy of the invention following forging and anneal. The grain size is ASTM Grain No. 2.5 indicative of grain refinement compared to the as-cast microstructure.

Figure 3:
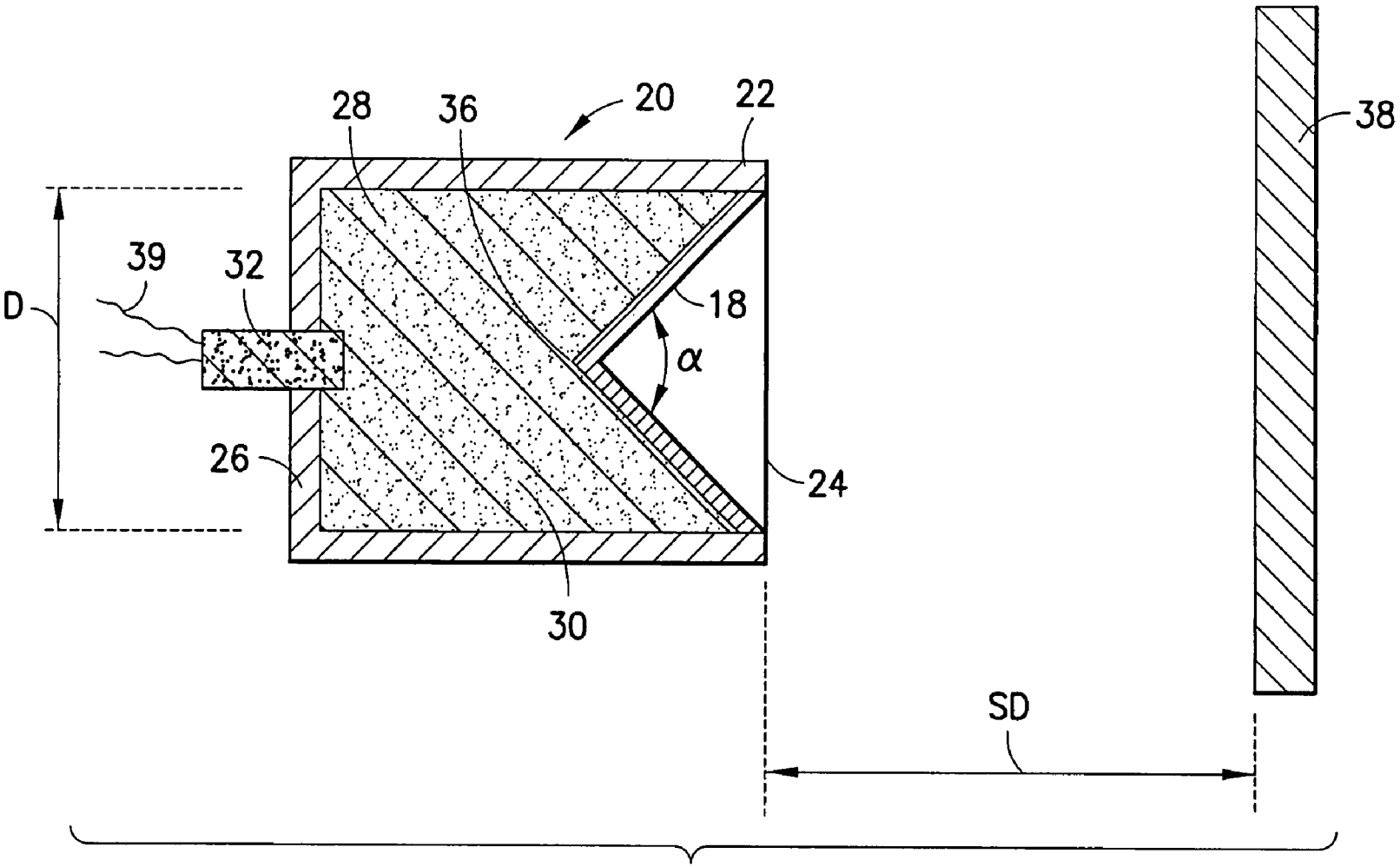
FIG. 3 illustrates in cross-sectional representation a shaped charge warhead in accordance with the invention.

With reference to FIG. 3, an application of the alloy of the invention is to form a liner 18 for a shaped charge device 20. The shaped charge device 20 has a housing 22 with an open end 24 and a closed end 26. Typically, the housing 20 is cylindrical, spherical or spheroidal in shape. The shaped charge liner 18 closes the open end 24 of the housing 22 and in combination with the housing 22 defines an internal cavity 28.

The shaped charge liner 18 is usually conical in shape and has a relatively small included angle, $\alpha$. $\alpha$ is typically on the order of 30 degrees to 90 degrees.

A secondary explosive 30, such as plastic bonded explosive (PBX) fills the internal cavity 28. A primary explosive 32, detonatable such as by application of an electric current through wires 34, contacts the secondary explosive 30 adjacent closed end 26 at a point opposite the apex 36 of the shaped charge liner 18.

The shaped charge device 20 is fired when positioned a desired standoff distance, SD, from a target 38. The standoff distance is typically defined as a multiple of the charge diameter, D, and is typically on the order of 3-6 times the charge diameter.

Detonation of the primary explosive generates a shock wave in the secondary explosive that travels through the secondary explosive collapsing the shaped charge liner and expelling a penetrating jet. The penetrating jet is a relatively small diameter, on the order of 2% of the charge diameter, cylinder of liquid metal that travels at very high speeds.

In general, bulk sound speed, defined as the velocity of a sound wave through the material, gives a good measure of how a material will behave when forming a shaped charged jet. Materials with high bulk sound speeds form higher velocity coherent jets and have better armor penetration performance. The alloys of the invention have a sound speed higher than that of copper but slightly less than that of molybdenum and should form a jet with an effective velocity and with the added performance of increased density.

While described above as a vacuum cast, single phase, alloy made up of multiple discrete crystals, the alloy of the invention could be grown as a single crystal using a process similar to that used to form nickel-base superalloy stock for turbine engine blades. The single crystal material may have unique properties for ballistic applications. This method could include the process steps of forming a molten mixture an alloy consisting essentially of from a trace to 90%, by weight, of cobalt, from 10% to 50% by weight, of tungsten and the balance nickel and inevitable impurities. Careful control of mold design and cooling rate would cause the cast material to solidify as a single crystal. The material would be used as-cast because working would likely lead to recrystallization.

While the alloy of the invention is particularly useful as a liner for a shaped charge device, the material could also find application as a high performance, high density, replacement for cast iron and steel fragmentation warheads and cases. The alloy of the invention also has application as replacement for lead materials in ammunition, radiation shielding and weighting. The alloy has a density that is equivalent to lead while being potentially more environmentally friendly. It is also stronger and can be used in higher temperature applications than lead.

Further advantages of the alloy of the invention will be apparent from the example that follows.

EXAMPLE

An alloy having the composition, by weight, of 44% nickel-37% tungsten-19% cobalt was melted in a vacuum at 1,600° C. and held at temperature for one hour prior to cooling. The alloy had a measured density of 11.1 g/cm$^3$. The mechanical properties of the as cast alloy at room temperature (nominally 22 degrees C.) were measured and are reported in Table 1.

TABLE 1

| Material | Ultimate Tensile Strength (ksi) | 0.2% Offset Tensile Yield Strength (ksi) | Tensile Elongation (%) | Density ($g/cm^3$) | Bulk Sound Speed (km/s) |
|---|---|---|---|---|---|
| Inventive Alloy (as cast) | 70 | 51 | 22 | 11.1 | 4.47 |
| Inventive Alloy (Forged and Annealed) | 122 | 78 | 60 | 11.1 | — |
| OFE Copper | 34 | 10 | 45 | 8.9 | 3.93 |
| Armco Iron | 39 | 25 | 57 | 7.8 | — |
| Tantalum | 32 | 23 | 60 | 16.6 | 3.39 |
| Silver | 26 | — | 50 | 10.5 | — |
| Molybdenum | 72 | 55 | — | 10.2 | 5.04 |

OFE Copper = Oxygen free electronic copper (99.99% by weight Cu minimum)
Armco Iron = Commercially pure iron (nominally 99.9%, by weight, Fe, 0.015% C and trace amounts of Mn and P.

The alloy was then cold worked by 20-25% reduction in cross sectional area by swaging and annealed at a temperature of about 1,000° C. in a nitrogen atmosphere for one hour. The forged and annealed alloy properties were measured and are reported in Table 1.

Table 1 compares the properties of the alloy of the invention to a number of conventional materials commonly used as liners for shaped charge devices. The alloy of the invention has significantly higher tensile strengths and density, a tensile elongation as good as silver and a bulk sound speed superior to copper and tantalum. The alloy of the invention has potentially the best combination of properties for a shaped charge liner.

One or more embodiments of the present invention have been described. Nevertheless, it will be understood that various modifications may be made without departing from the spirit and scope of the invention. Accordingly, other embodiments are within the scope of the following claims.

What is claimed is:

1. A metal alloy consisting essentially of:
from 10% to 22%, by weight, of cobalt;
from 30% to 40% by weight, of tungsten;
and the balance nickel and inevitable impurities, said metal alloy having a single phase microstructure and an elongation of at least 50% at 22° C.

2. The metal alloy of claim 1 consisting essentially of:
from 16% to 22%, by weight, of cobalt;
from 35% to 40% by weight, of tungsten;
and the balance nickel and inevitable impurities.

3. The metal alloy of claim 1 being formed into a product selected from the group consisting of a fragmentation warhead, a warhead casing, ammunition, radiation shielding and weighting.

4. The metal alloy of claim 1 being formed into a shaped charge liner.

5. The metal alloy of claim 1 being Conned into an explosively formed penetrator.

* * * * *